US007011371B1

(12) United States Patent
Tsai

(10) Patent No.: US 7,011,371 B1
(45) Date of Patent: Mar. 14, 2006

(54) ARMREST ASSEMBLY HAVING A HEIGHT ADJUSTABLE FUNCTION

(76) Inventor: Po-Chuan Tsai, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/998,245

(22) Filed: Nov. 29, 2004

(51) Int. Cl.
*A47C 7/54* (2006.01)

(52) U.S. Cl. ..... 297/411.36; 297/353

(58) Field of Classification Search ..... 297/411.36, 297/353
See application file for complete search history.

(56) References Cited

U.S. PATENT DOCUMENTS

| | | | | | |
|---|---|---|---|---|---|
| 5,382,079 | A * | 1/1995 | Wilson et al. | ..... | 297/411.36 |
| 5,620,233 | A * | 4/1997 | Corwin | ..... | 297/411.36 |
| 5,647,638 | A * | 7/1997 | Ritt et al. | ..... | 297/411.36 |
| 5,829,839 | A * | 11/1998 | Wilkerson et al. | ..... | 297/411.36 |
| 5,848,823 | A * | 12/1998 | Su | ..... | 297/411.36 |
| 5,853,223 | A * | 12/1998 | Ritt et al. | ..... | 297/411.36 |
| 5,931,537 | A * | 8/1999 | Gollin et al. | ..... | 297/411.36 |
| 6,053,579 | A * | 4/2000 | Nelson et al. | ..... | 297/411.36 |
| 6,139,107 | A * | 10/2000 | Lee | ..... | 297/411.36 |
| 6,209,961 | B1 * | 4/2001 | Chen | ..... | 297/411.36 |
| 6,315,362 | B1 * | 11/2001 | Chuang | ..... | 297/411.36 |
| 6,336,680 | B1 * | 1/2002 | Lee | ..... | 297/411.36 |
| 6,343,840 | B1 * | 2/2002 | Chuang | ..... | 297/411.36 |
| 6,398,309 | B1 * | 6/2002 | Chen | ..... | 297/411.36 |
| 6,419,323 | B1 * | 7/2002 | Chu et al. | ..... | 297/411.36 |
| 6,540,300 | B1 * | 4/2003 | Piretti | ..... | 297/411.36 X |
| 6,702,386 | B1 * | 3/2004 | Davis et al. | ..... | 297/411.36 X |
| 6,773,072 | B1 * | 8/2004 | Phillips et al. | ..... | 297/411.35 |
| 6,824,217 | B1 * | 11/2004 | Wang | ..... | 297/411.36 |
| 6,827,406 | B1 * | 12/2004 | Marini | ..... | 297/411.36 |
| 6,840,582 | B1 * | 1/2005 | Burwell et al. | ..... | 297/411.36 |
| 2003/0214171 | A1 * | 11/2003 | Burwell et al. | ..... | 297/411.36 |
| 2004/0239170 | A1 * | 12/2004 | Wang | ..... | 297/411.36 |
| 2005/0146191 | A1 * | 7/2005 | Machael et al. | ..... | 297/411.36 |

* cited by examiner

*Primary Examiner*—Rodney B. White
(74) *Attorney, Agent, or Firm*—Alan D. Kamrath; Nikolai & Mersereau, P.A.

(57) ABSTRACT

An armrest assembly includes an L-shaped support having a vertical section, a lift mechanism telescopically mounted in the vertical section of the support, a sleeve movably mounted on the vertical section of the support and secured on the lift mechanism to move therewith, and an armrest secured on the lift mechanism to move therewith. Thus, the armrest can be moved on the vertical section of the support upward and downward adjust the height of the armrest so as to fit requirements of different users. In addition, the user only needs to drive the control member to release the movable shaft from the limit plate so as to adjust the height of the armrest easily and conveniently, thereby facilitating the user adjusting the height of the armrest.

17 Claims, 9 Drawing Sheets

ARMREST ASSEMBLY HAVING A HEIGHT ADJUSTABLE FUNCTION

BACKGROUND OF THE INVENTION

1. Field of the Invention

The present invention relates to an armrest assembly for a chair, and more particularly to an armrest assembly having a height adjustable function.

2. Description of the Related Art

A conventional chair includes two armrests mounted on a seat. However, the height of the two armrests is fixed and cannot be adjusted so as to fit statures of different users, thereby limiting the versatility of the chair, and thereby causing inconvenience to the users having different statures.

SUMMARY OF THE INVENTION

In accordance with the present invention, there is provided an armrest assembly, comprising:

an L-shaped support having a vertical section;

a lift mechanism telescopically mounted in the vertical section of the support;

a sleeve movably mounted on the vertical section of the support and secured on the lift mechanism to move therewith;

an armrest secured on the lift mechanism to move therewith.

The primary objective of the present invention is to provide an armrest assembly having a height adjustable function.

Another objective of the present invention is to provide an armrest assembly, wherein the armrest can be moved on the vertical section of the support upward and downward adjust the height of the armrest so as to fit requirements of different users.

A further objective of the present invention is to provide an armrest assembly, wherein the user only needs to drive the control member to release the movable shaft from the limit plate so as to adjust the height of the armrest easily and conveniently, thereby facilitating the user adjusting the height of the armrest.

Further benefits and advantages of the present invention will become apparent after a careful reading of the detailed description with appropriate reference to the accompanying drawings.

DETAILED DESCRIPTION OF THE INVENTION

Figure 1:
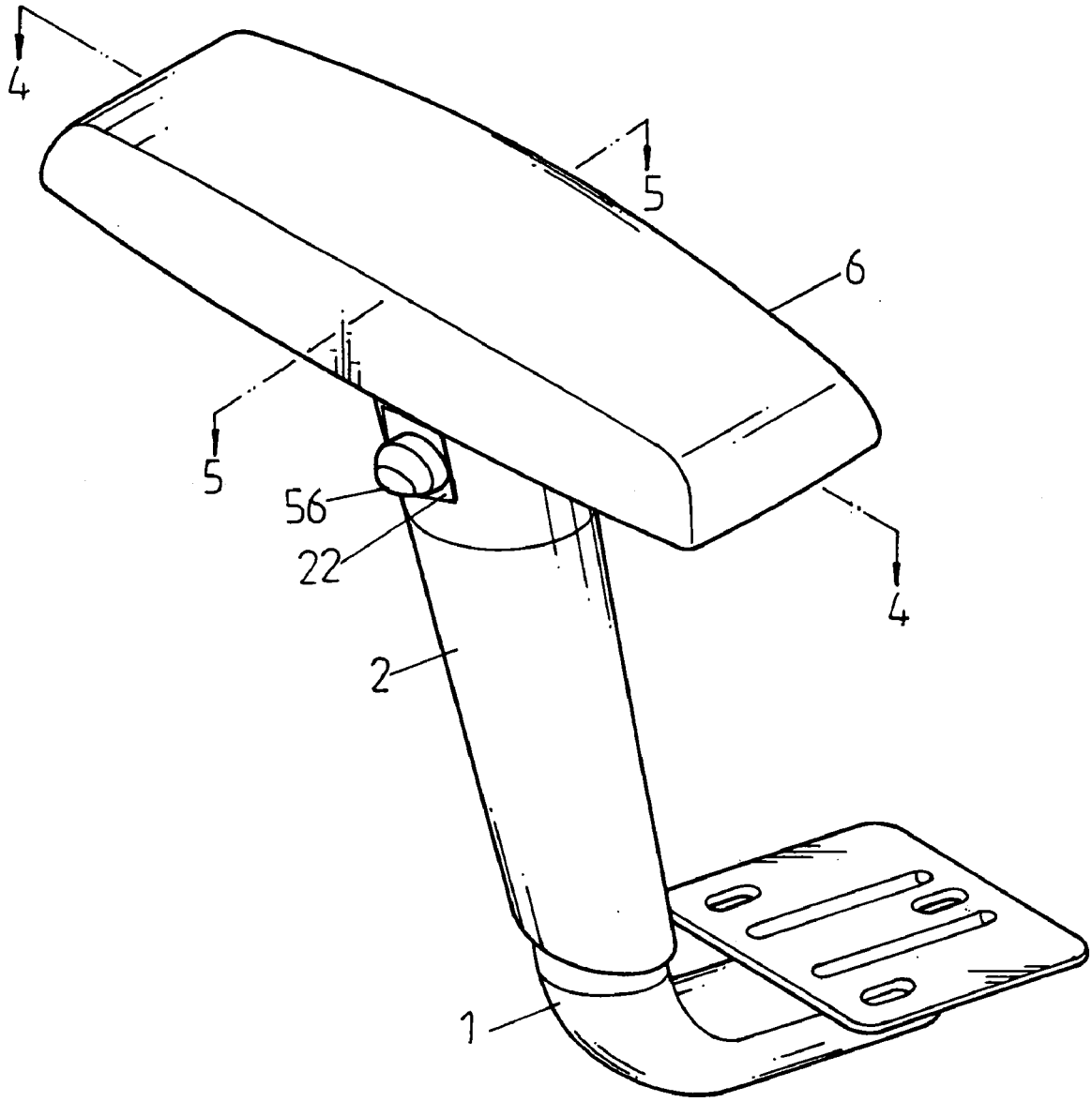
FIG. 1 is a perspective view of an armrest assembly in accordance with the preferred embodiment of the present invention.

Referring to the drawings and initially to FIGS. 1–5, an armrest assembly for a chair in accordance with the preferred embodiment of the present invention comprises an L-shaped support 1 having a vertical section 10 having an inside formed with a chamber 11, a lift mechanism 5 telescopically mounted in the chamber 11 of the vertical section 10 of the support 1, a sleeve 2 movably mounted on the vertical section 10 of the support 1 and secured on the lift mechanism 5 to move therewith, and an armrest 6 secured on the lift mechanism 5 to move therewith.

The vertical section 10 of the support 1 has a top formed with a plurality of recesses 12.

A resting plate 3 is secured in the chamber 11 of the vertical section 10 of the support 1 and has a plurality of lugs 30 secured in the recesses 12 of the vertical section 10 of the support 1. The resting plate 3 has a through hole 31 and two screw bores 32.

A limit plate 4 is secured in the chamber 11 of the vertical section 10 of the support 1 and has a semi-circular hole 40 having a planar stop side 400. The limit plate 4 is rested on the resting plate 3 and has two screw bores 41 secured on the screw bores 32 of the resting plate 3 by two screws 7, so that the limit plate 4 is secured on the resting plate 3.

The sleeve 2 has an inside formed with a passage 20 mounted on the vertical section 10 of the support 1 and has a top formed with a plurality of screw bores 21. The sleeve 2 has a side formed with a slide slot 22 connected to the passage 20.

The lift mechanism 5 includes a movable shaft 50, a connecting plate 54, a first positioning member 53, a second positioning member 52, a spring 51, and a control member 55.

The movable shaft 50 is movably and rotatably mounted in the chamber 11 of the vertical section 10 of the support 1 and having a cylindrical first portion 501 protruded from and rotatably mounted on the limit plate 4 and a semi-circular second portion 502 having a planar side 507 and a toothed side 506 and having a distal end formed with a stop 505. The first portion 501 of the movable shaft 50 has a periphery formed with an oblique guide groove 504 and has an end face formed with a stub 500 having a slit 503.

Thus, the first portion 501 of the movable shaft 50 is rotatable between a first position where the toothed side 506 of the second portion 502 of the movable shaft 50 is stopped by the stop side 400 of the semi-circular hole 40 of the limit plate 4 and a second position where the planar side 507 of the second portion 502 of the movable shaft 50 is aligned with the stop side 400 of the semi-circular hole 40 of the limit plate 4, so that the second portion 502 of the movable shaft 50 is movable in the semi-circular hole 40 of the limit plate 4.

The connecting plate 54 has a periphery formed with a plurality of screw bores 544 secured on the screw bores 21 of the sleeve 2 by a plurality of screws 90, so that the connecting plate 54 is secured on the top of the sleeve 2. The connecting plate 54 has two screw holes 543 and has a top formed with a stud 541 having a screw bore 542 and a bottom formed with a cruciform protrusion 540.

The first positioning member 53 has a top formed with a cruciform seat 531 secured on the cruciform protrusion 540 of the connecting plate 54 and two screw holes 532 secured on the screw holes 543 of the connecting plate 54 by two screws 9, so that the first positioning member 53 is secured on the connecting plate 54. The first positioning member 53 has a bottom formed with a circular recess 533 and two screw bores 535. The recess 533 of the first positioning member 53 is mounted on the first portion 501 of the movable shaft 50 and has a first side formed with a U-shaped first groove 536 and a second side formed with a slit 534. The first positioning member 53 has a side formed with a slideway 530 connected to the first groove 536.

Figure 5:
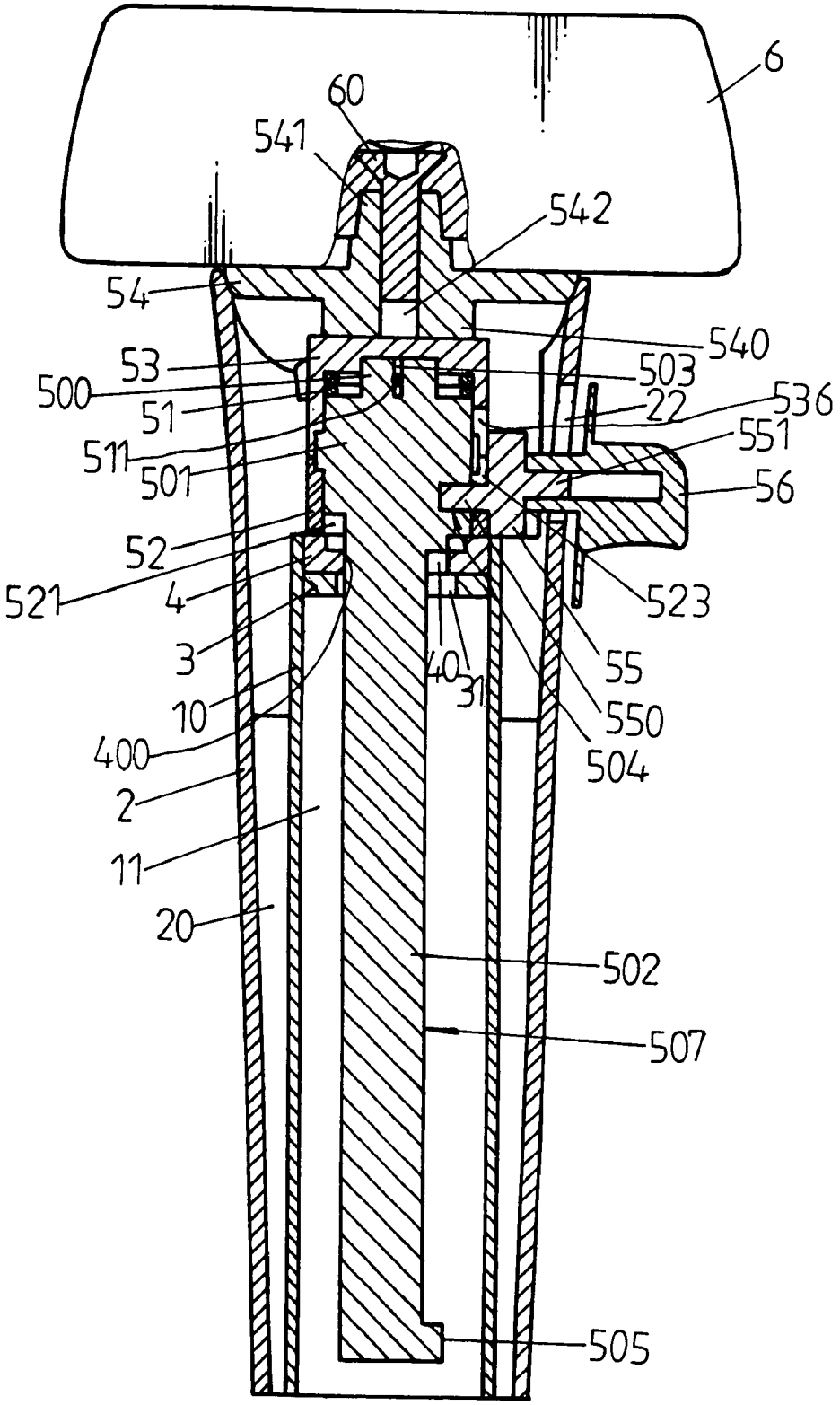
FIG. 5 is a plan cross-sectional view of the armrest assembly taken along line 5—5 as shown in FIG. 1.

The second positioning member 52 has a hole 521 mounted on the first portion 501 of the movable shaft 50 and two screw bores 522 secured on the screw bores 535 of the first positioning member 53 by two screws 8, so that the second positioning member 52 is secured on the first positioning member 53. The hole 521 of the second positioning member 52 has a side formed with a U-shaped second groove 523 aligning with the first groove 536 of the first positioning member 53 to form an oblong guide slot as shown in FIG. 5. The second positioning member 52 has a side formed with a slideway 520 connected to the second groove 523 and aligning with the slideway 530 of the first positioning member 53.

The spring 51 is mounted in the recess 533 of the first positioning member 53 and has a first end 510 secured in the slit 534 of the first positioning member 53 and a second end 511 secured in the slit 503 of the stub 500 of the first portion 501 of the movable shaft 50.

The control member 55 is slidably mounted in the slideway 530 of the first positioning member 53 and the slideway 520 of the second positioning member 52 and has a first side formed with a drive lever 550 extended through the first groove 536 of the first positioning member 53 and the second groove 523 of the second positioning member 52 and slidably mounted in the oblique guide groove 504 of the first portion 501 of the movable shaft 50 so as to push and rotate the first portion 501 of the movable shaft 50. The control member 55 has a second side formed with a control lever 551 slidably mounted in the slide slot 22 of the sleeve 2, and a control knob 56 is slidably mounted on the sleeve 2 and has a side secured on the control lever 551 of the control member 55 to move the control member 55.

The armrest 6 has a bottom provided with a screw 60 screwed into the screw bore 542 of the stud 541 of the connecting plate 54, so that the armrest 6 is secured on the connecting plate 54.

Figure 4:
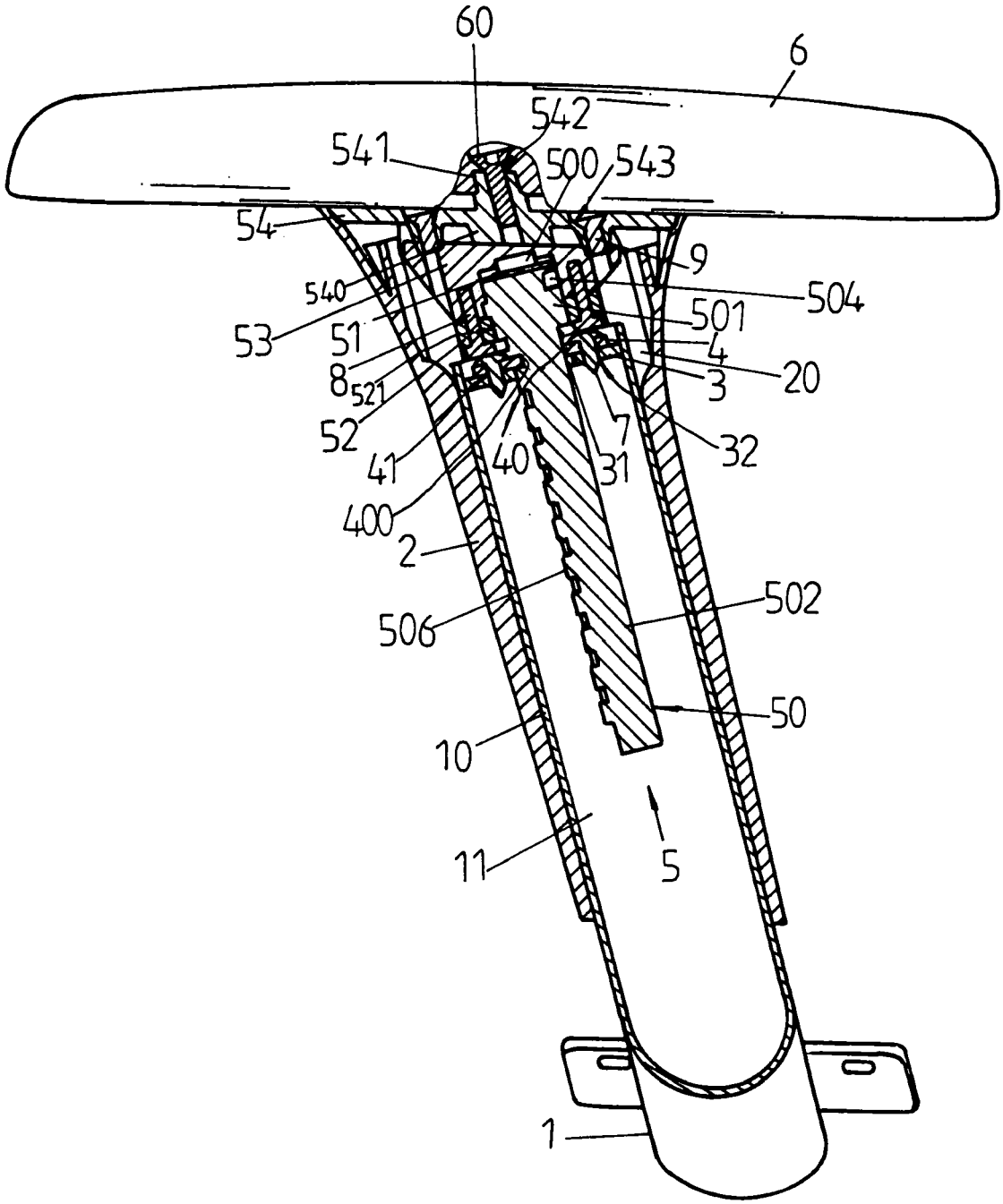
FIG. 4 is a plan cross-sectional view of the armrest assembly taken along line 4—4 as shown in FIG. 1.

In operation, referring to FIGS. 1–8, the first portion 501 of the movable shaft 50 is initially located at its first position as shown in FIGS. 4 and 5 so that the toothed side 506 of the second portion 502 of the movable shaft 50 is stopped by the stop side 400 of the semi-circular hole 40 of the limit plate 4. At this time, the drive lever 550 of the control member 55 is located at the bottom of the oblique guide groove 504 of the first portion 501 of the movable shaft 50, and the spring 51 is disposed at a loosened state.

Figure 6:
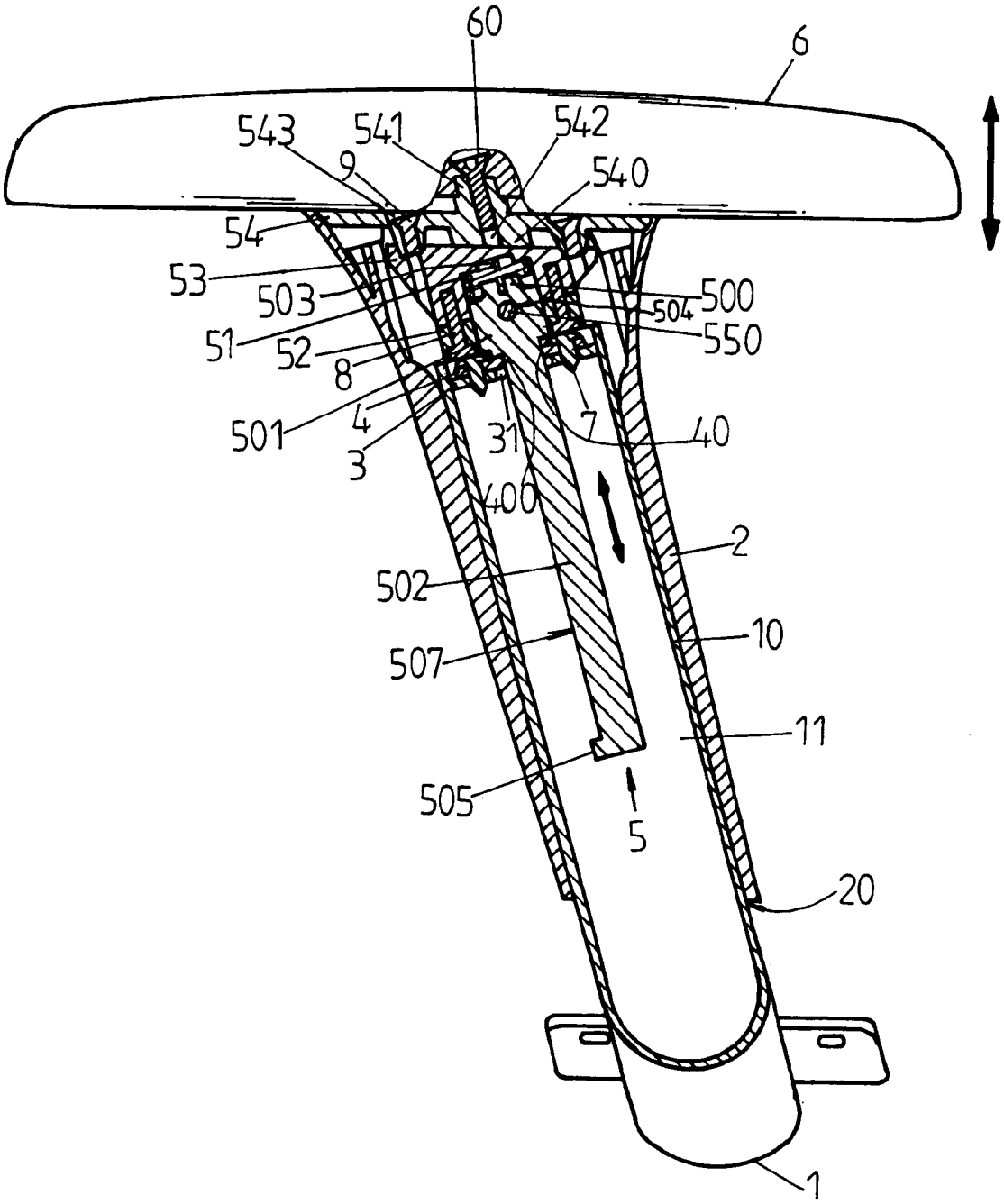
FIG. 6 is a schematic operational view of the armrest assembly as shown in FIG. 4.
Figure 7:
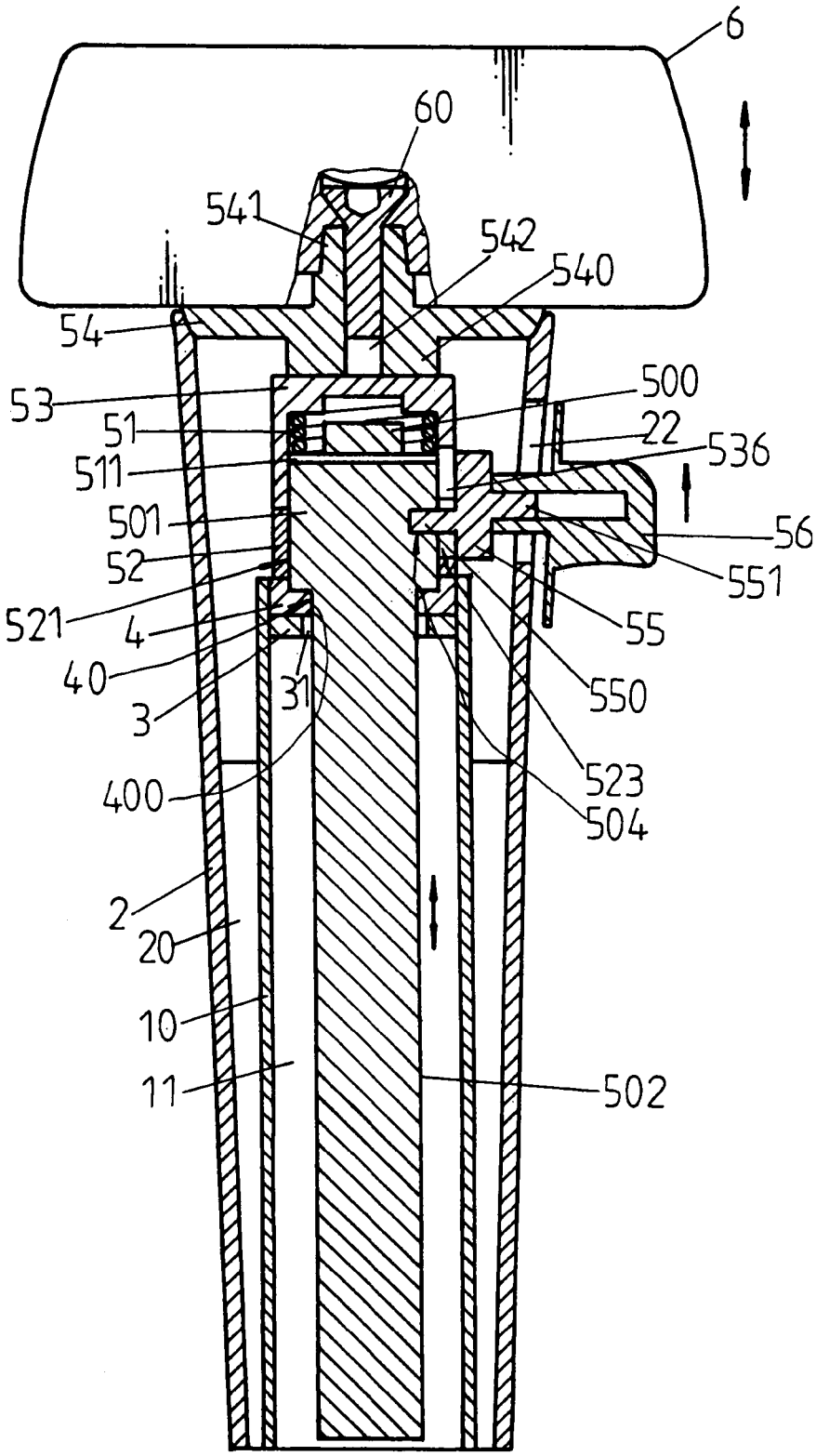
FIG. 7 is a schematic operational view of the armrest assembly as shown in FIG. 5.

When the control member 55 is driven by the control knob 56 to move upward, the drive lever 550 of the control member 55 is moved in the oblique guide groove 504 of the first portion 501 of the movable shaft 50. When the drive lever 550 of the control member 55 is moved to the top of the oblique guide groove 504 of the first portion 501 of the movable shaft 50, the first portion 501 of the movable shaft 50 is rotated through a determined angle to its second position as shown in FIGS. 6 and 7 where the planar side 507 of the second portion 502 of the movable shaft 50 is aligned with the stop side 400 of the semi-circular hole 40 of the limit plate 4, so that the second portion 502 of the movable shaft 50 is movable in the semi-circular hole 40 of the limit plate 4 so as to release the armrest 6 and the sleeve 2 from the vertical section 10 of the support 1.

Figure 8:
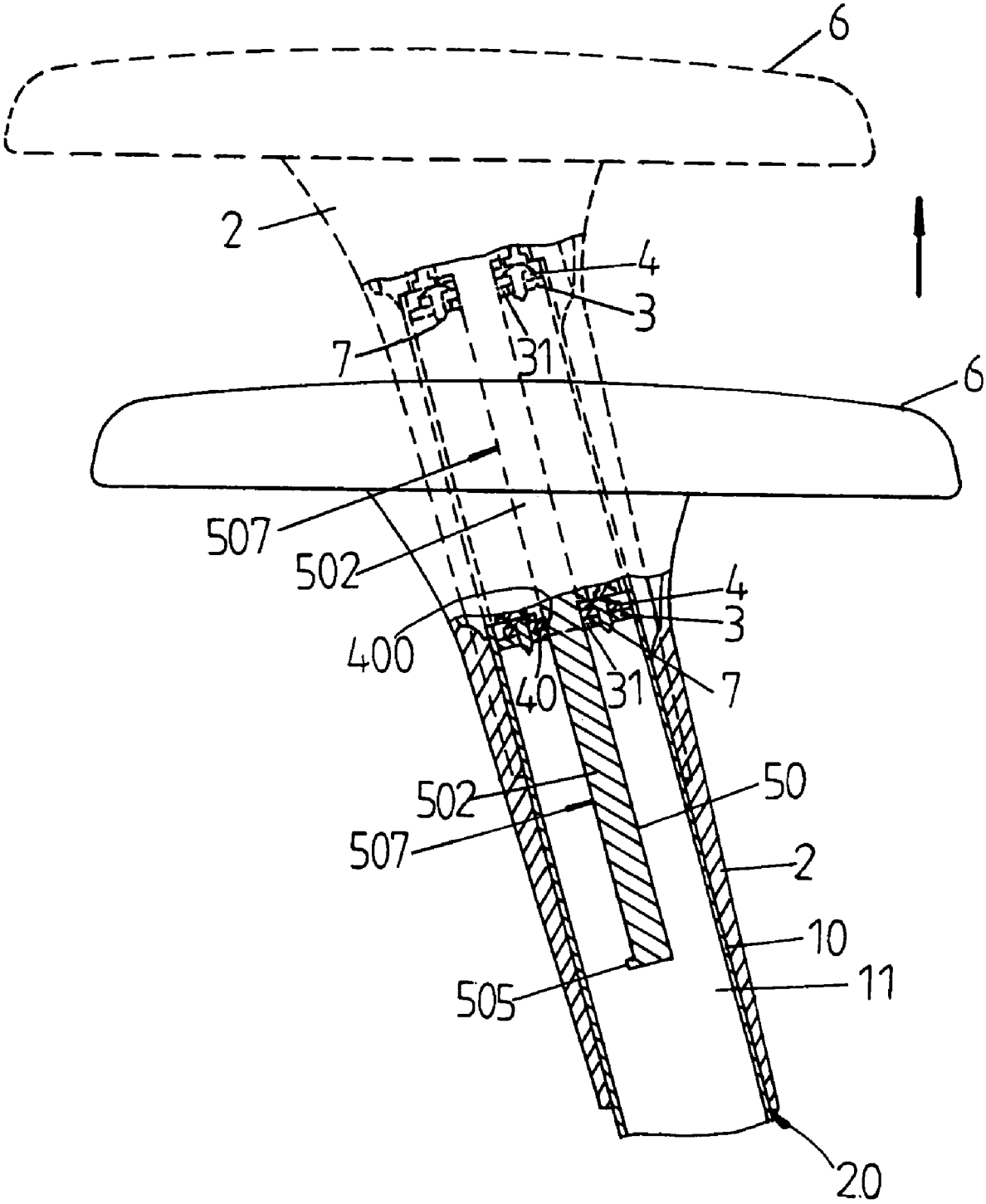
FIG. 8 is a schematic operational view of the armrest assembly as shown in FIG. 6.

Thus, the armrest 6 can be freely moved on the vertical section 10 of the support 1 upward and downward as shown in FIG. 8 so as to adjust the height of the armrest 6.

In addition, the stop 505 of the second portion 502 of the movable shaft 50 is movable to abut the stop side 400 of the semi-circular hole 40 of the limit plate 4 to prevent the second portion 502 of the movable shaft 50 from detaching from the semi-circular hole 40 of the limit plate 4.

After the armrest 6 is moved to the determined position, the control member 55 is released, and the first portion 501 of the movable shaft 50 is rotated to the original position by the restoring force of the spring 51, so that the toothed side 506 of the second portion 502 of the movable shaft 50 is stopped and locked by the stop side 400 of the semi-circular hole 40 of the limit plate 4 again, thereby fixing the movable shaft 50 on the limit plate 4 so as to fix the armrest 6 on the vertical section 10 of the support 1.

At the same time, the drive lever 550 of the control member 55 is moved downward in the oblique guide groove 504 of the first portion 501 of the movable shaft 50 during rotation of the movable shaft 50 to the bottom of the oblique guide groove 504 of the first portion 501 of the movable shaft 50.

Accordingly, the armrest 6 can be moved on the vertical section 10 of the support 1 upward and downward adjust the height of the armrest 6 so as to fit requirements of different users. In addition, the user only needs to drive the control member 55 to release the movable shaft 50 from the limit plate 4 so as to adjust the height of the armrest 6 easily and conveniently, thereby facilitating the user adjusting the height of the armrest 6.

Figure 2:
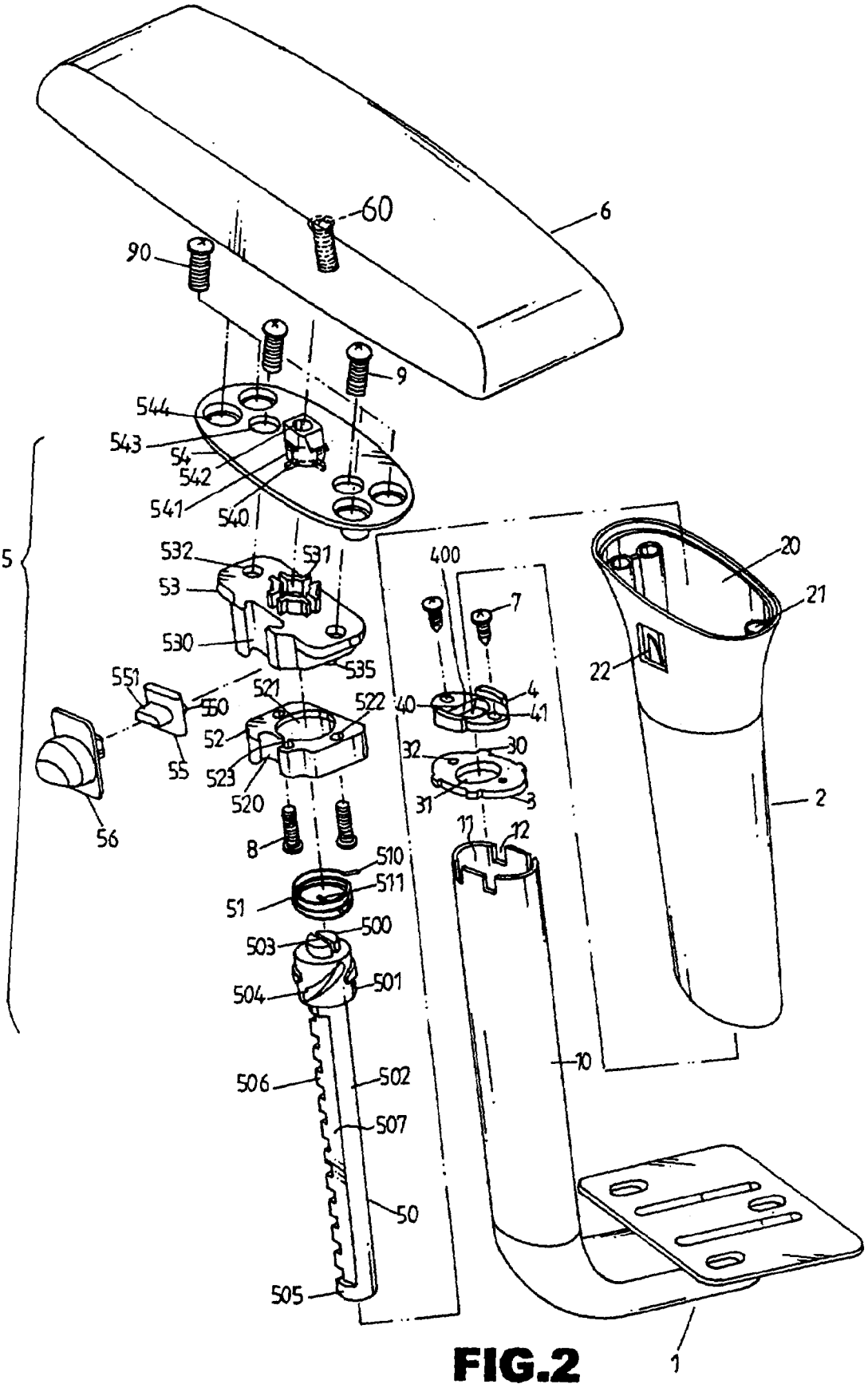
FIG. 2 is an exploded perspective view of the armrest assembly as shown in FIG. 1.
Figure 3:
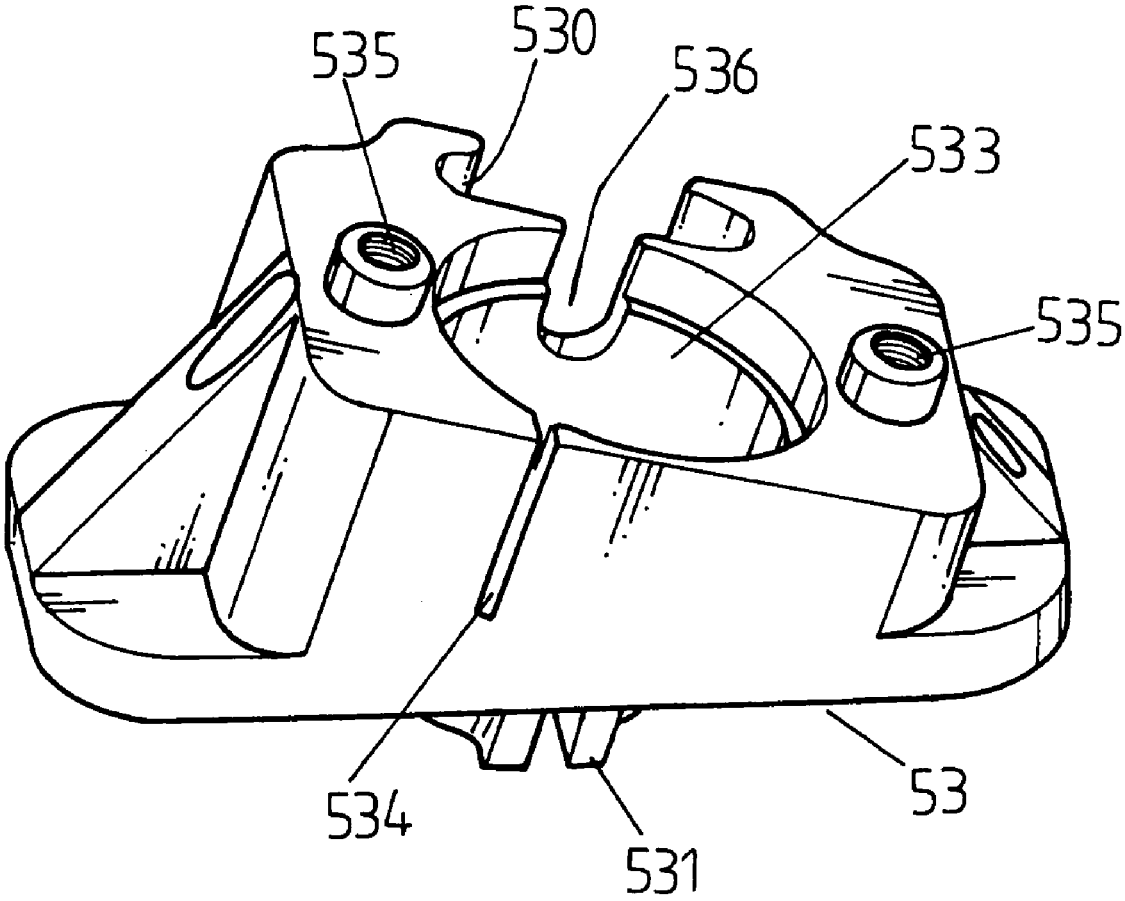
FIG. 3 is a perspective view of a first positioning member of the armrest assembly as shown in FIG. 2.
Figure 9:
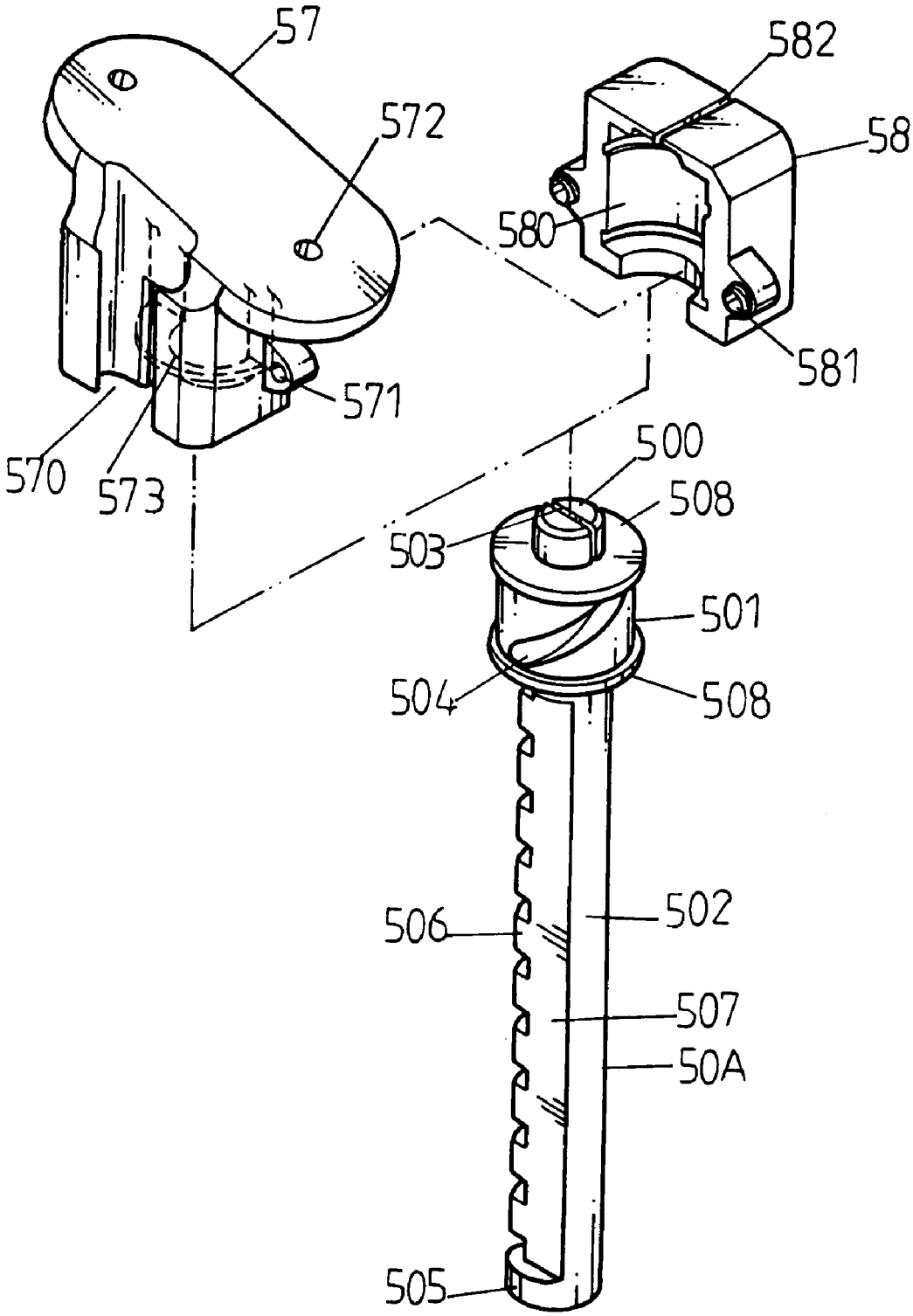
FIG. 9 is a partially exploded perspective view of an armrest assembly in accordance with another embodiment of the present invention.

Referring to FIG. 9 with reference to FIG. 2, the first positioning member 57 has a first side formed with a semi-circular recess 573 and a second side formed with a slideway 570 connected to the semi-circular recess 573. The first positioning member 57 has two screw bores 571. The first positioning member 57 has a top formed with two screw holes 572 secured on the screw holes 543 of the connecting plate 54 by two screws 9, so that the first positioning member 57 is secured on the connecting plate 54.

The second positioning member 58 has a side formed with a semi-circular recess 580 aligning with the semi-circular recess 573 of the first positioning member 57 to form a circular recess to receive the first portion 501 of the movable shaft 50A. The second positioning member 58 has a top formed with a slit 582. The second positioning member 58 has two screw bores 581 secured on the two screw bores 571 of the first positioning member 57, so that the second positioning member 58 is secured on the first positioning member 57.

The first portion 501 of the movable shaft 50A has two spaced annular flanges 508 rotatably mounted in the circular recess of the first positioning member 57 and the second positioning member 58.

The spring 51 is mounted in the circular recess of the first positioning member 57 and the second positioning member 58 and has a first end 510 secured in the slit 582 of the second positioning member 58 and a second end 511 secured in the slit 503 of the stub 500 of the first portion 501 of the movable shaft 50A.

The control member 55 is slidably mounted in the slideway 570 of the first positioning member 57 and has a first side formed with a drive lever 550 extended through the semi-circular recess 573 of the first positioning member 57 and slidably mounted in the oblique guide groove 504 of the first portion 501 of the movable shaft 50A so as to push and rotate the first portion 501 of the movable shaft 50.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An armrest assembly, comprising:

an L-shaped support having a vertical section;

a lift mechanism telescopically mounted in the vertical section of the support;

a sleeve movably mounted on the vertical section of the support and secured on the lift mechanism to move therewith;

an armrest secured on the lift mechanism to move therewith;

a limit plate secured in the vertical section of the support and having a semi-circular hole having a planar stop side, wherein the lift mechanism includes a movable shaft movably and rotatable mounted in the vertical section of the support and having a cylindrical first portion protruded from and rotatably mounted on the limit plate and a semi-circular second portion having a planar side and a toothed side.

2. The armrest assembly in accordance with claim 1, wherein the second portion of the movable shaft has a distal end formed with a stop.

3. The armrest assembly in accordance with claim 1, wherein the first portion of the movable shaft is rotatable between a first position where the toothed side of the second portion of the movable shaft is stopped by the stop side of the semi-circular hole of the limit plate and a second position where the planar side of the second portion of the movable shaft is aligned with the stop side of the semi-circular hole of the limit plate, so that the second portion of the movable shaft is movable in the semi-circular hole of the limit plate.

4. The armrest assembly in accordance with claim 1, wherein the first portion of the movable shaft has a periphery formed with an oblique guide groove, and the lift mechanism further includes a connecting plate, a first positioning member, a second positioning member, and a control member, wherein:

the connecting plate is secured on a top of the sleeve;

the first positioning member is secured on the connecting plate and has a bottom formed with a circular recess mounted on the first portion of the movable shaft and having a first side formed with a U-shaped first groove;

the second positioning member is secured on the first positioning member and has a hole mounted on the first portion of the movable shaft and having a side formed with a U-shaped second groove aligning with the first groove of the first positioning member;

the control member has a first side formed with a drive lever extended through the first groove of the first positioning member and the second groove of the second positioning member and slidably mounted in the oblique guide groove of the first portion of the movable shaft so as to push and rotate the first portion of the movable shaft.

5. The armrest assembly in accordance with claim 4, wherein the first positioning member has a side formed with a slideway connected to the first groove, the second positioning member has a side formed with a slideway connected to the second groove and aligning with the slideway of the first positioning member, and the control member is slidably mounted in the slideway of the first positioning member and the slideway of the second positioning member.

6. The armrest assembly in accordance with claim 4, wherein the control member has a second side formed with a control lever slidably mounted in a slide slot of the sleeve, and the lift mechanism further includes a control knob slidably mounted on the sleeve and having a side secured on the control lever of the control member to move the control member.

7. The armrest assembly in accordance with claim 4, wherein the first portion of the movable shaft has an end face formed with a stub having a slit, the recess of the first positioning member has a second side formed with a slit, and the lift mechanism further includes a spring mounted in the recess of the first positioning member and having a first end secured in the slit of the first positioning member and a second end secured in the slit of the stub of the first portion of the movable shaft.

8. The armrest assembly in accordance with claim 4, wherein the sleeve has a top formed with a plurality of screw bores, and the connecting plate has a periphery formed with a plurality of screw bores secured on the screw bores of the sleeve by a plurality of screws, so that the connecting plate is secured on the top of the sleeve.

9. The armrest assembly in accordance with claim 4, wherein the connecting plate has two screw holes, and the first positioning member has a top formed with two screw holes secured on the screw holes of the connecting plate by two screws, so that the first positioning member is secured on the connecting plate.

10. The armrest assembly in accordance with claim 4, wherein the connecting plate has a bottom formed with a cruciform protrusion, and the first positioning member has a top formed with a cruciform seat secured on the cruciform protrusion of the connecting plate.

11. The armrest assembly in accordance with claim 4, wherein the connecting plate has a top formed with a stud having a screw bore, and the armrest has a bottom provided with a screw screwed into the screw bore of the stud of the connecting plate, so that the armrest is secured on the connecting plate.

12. The armrest assembly in accordance with claim 4, wherein the bottom of the first positioning member is formed with two screw bores, and the second positioning member has two screw bores secured on the screw bores of the first positioning member by two screws, so that the second positioning member is secured on the first positioning member.

13. The armrest assembly in accordance with claim 1, wherein the sleeve has an inside formed with a passage mounted on the vertical section of the support.

14. The armrest assembly in accordance with claim 1, further comprising a resting plate secured in the vertical section of the support.

15. The armrest assembly in accordance with claim 14, wherein the vertical section of the support has a top formed with a plurality of recesses, and the resting plate has a plurality of lugs secured in the recesses of the vertical section of the support.

16. The armrest assembly in accordance with claim 14, wherein the limit plate is rested on the resting plate.

17. The armrest assembly in accordance with claim 16, wherein the resting plate has two screw bores, and the limit plate has two screw bores secured on the screw bores of the resting plate by two screws, so that the limit plate is secured on the resting plate.

* * * * *